US006902039B2

(12) United States Patent
Kunch

(10) Patent No.: US 6,902,039 B2
(45) Date of Patent: Jun. 7, 2005

(54) PROTECTIVE SHIELD APPARATUS FOR FORK LIFT TRUCKS

(76) Inventor: Timothy R. Kunch, 6603 W. Phelps, Glendale, AZ (US) 85306

( * ) Notice: Subject to any disclaimer, the term of this patent is extended or adjusted under 35 U.S.C. 154(b) by 61 days.

(21) Appl. No.: 10/138,563

(22) Filed: May 6, 2002

(65) Prior Publication Data

US 2003/0206792 A1 Nov. 6, 2003

(51) Int. Cl.[7] ..... B66F 9/075
(52) U.S. Cl. ..... 187/222; 414/607
(58) Field of Search ..... 414/607, 785; 187/237, 238, 222

(56) References Cited

U.S. PATENT DOCUMENTS

| | | | | |
|---|---|---|---|---|
| 2,956,701 A | | 10/1960 | Larson | |
| 3,625,385 A | | 12/1971 | Ide | |
| 3,780,896 A | * | 12/1973 | Crawford | 414/667 |
| 4,002,256 A | * | 1/1977 | Kroboth | 414/785 |
| 4,102,464 A | | 7/1978 | Schuster | |
| 4,334,820 A | * | 6/1982 | Homura | 414/607 |
| 4,478,314 A | | 10/1984 | Dorman | |
| 4,619,579 A | * | 10/1986 | Frison | 414/607 |
| 4,708,576 A | * | 11/1987 | Conley | 414/607 |
| 5,560,451 A | | 10/1996 | Hincks | |
| 5,618,159 A | | 4/1997 | Wilson | |

FOREIGN PATENT DOCUMENTS

| | | | |
|---|---|---|---|
| JP | 11-11889 | * | 1/1999 |
| WO | 96/22939 | * | 8/1996 |

* cited by examiner

*Primary Examiner*—Thomas J. Brahan
(74) *Attorney, Agent, or Firm*—H. Gordon Shields

(57) ABSTRACT

Shield apparatus for a fork lift truck includes a flat stiff plate securable to the mast or vertical portion of a carriage of a fork lift truck. The shield apparatus includes fasting elements which are adjustable to fit different sized mast elements of fork lift trucks made by different manufacturers. The shield apparatus comprises a relatively large and flat plate to fit the entire width of the carriage, including the vertical mast elements for the purpose of protecting material with relatively delicate edges, such as wall board, from being damaged while the material is being transported by the fork lift truck. Included are handle elements which allow the shield apparatus to be easily placed on and removed from a fork lift truck.

14 Claims, 2 Drawing Sheets

2/2

PROTECTIVE SHIELD APPARATUS FOR FORK LIFT TRUCKS

BACKGROUND OF THE INVENTION

1. Field of the Invention

This invention relates to fork lift trucks and, more particularly, to a shield for protecting materials from being damaged by the mast of a fork lift truck.

2. Description of the Prior Art

U.S. Pat. No. 2,956,701 (Larson) discloses a fork lift truck with a vertical element adjacent to the horizontal forks for protecting a pallet while the pallet is being lifted.

U.S. Pat. No. 3,625,385 (Ide) discloses a limit plate secured to the forks of a fork lift truck to limit the distance that a pallet may move on the forks. The purpose of the limit element is to protect adjacent cargo while the fork lift truck is loading pallets from rows of cargo laden pallets.

U.S. Pat. No. 4,102,464 (Schuster) discloses an impact bumper for protecting pallets and the cargo disposed on pallets.

U.S. Pat. No. 4,478,314 (Dorman) discloses a safety shield for a fork lift truck to protect the operator of the truck. The safety shield is transparent and is designed to protect the operator from hazardous cargo handled by the fork lift truck, such as explosives, dangerous chemicals, and the like.

U.S. Pat. No. 5,560,451 (Hincks) discloses shock absorber apparatus for a fork lift truck for protecting pallets.

U.S. Pat. No. 5,618,159 (Wilson) discloses another type of protective element for protecting materials transported by a fork lift truck. The protective element is flexible and fits around the vertical portion of the carriage of a fork lift truck.

SUMMARY OF THE INVENTION

The invention described and claimed herein comprises a shield securable to the vertical portion of a carriage of a fork lift truck. The shield is flat and relatively stiff and comprises a flat surface against which cargo being lifted by the fork lift trucks may be disposed and which will prevent damage to such cargo. When drywall, or wall board, is moved by a fork lift truck, the edges of the drywall are subject to damage, thus essentially ruining each sheet which has an edge damage. The shield apparatus of the present invention comprises a solid surface against which the drywall or other material having relatively fragile edges may be disposed and accordingly which prevents damage to the relatively fragile edges of the load, such as drywall or wallboard.

Among the objects of the present invention are the following:

To provide new and useful shield apparatus for a fork lift truck;

To provide new and useful shield apparatus easily disposed on the vertical mast or carriage of a fork lift truck;

To provide new and useful shield apparatus having a flat and solid surface against which material moved by a fork lift truck may be disposed; and To provide new and useful shield apparatus for a fork lift truck having adjustable fastening elements to allow the shield apparatus to be secured to masts of different makes of fork lift trucks.

DESCRIPTION OF THE PREFERRED EMBODIMENT

Figures 1, 2:
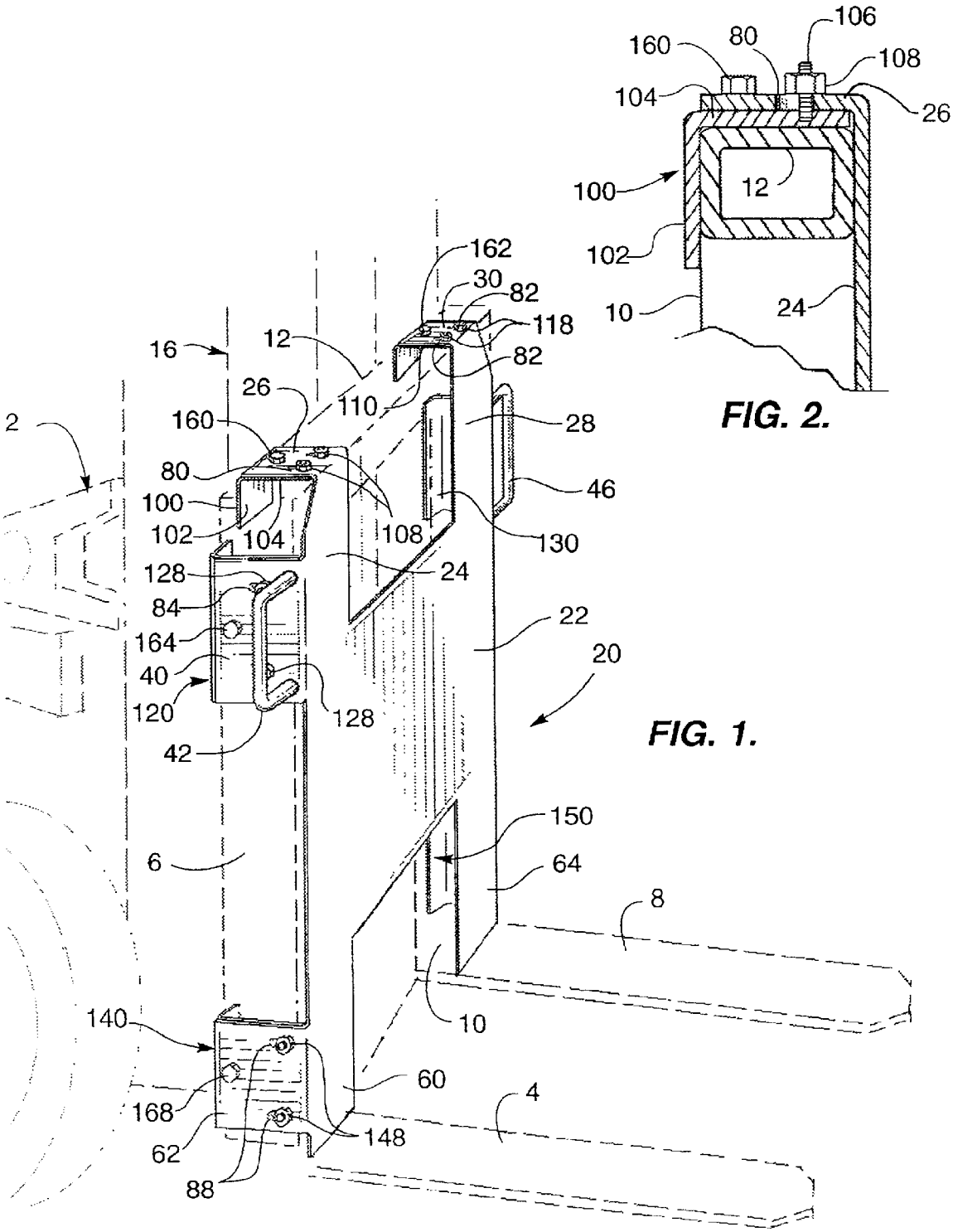
FIG. 1 is a perspective view of the apparatus of the present invention in its use environment.
FIG. 2 is a side view in partial section of a portion of the apparatus of the present invention.

FIG. 1 is a perspective view of a fork lift truck 2, shown in dashed line, with a fork lift shield 20 of the present invention disposed on the truck 2. The truck 2 includes a pair of generally horizontally extending forks 4 and 8 secured to a pair of generally vertically extending mast elements 6 and 10, respectively. Extending between the vertical members 6 and 10 is a horizontal member 12. The mast elements 6 and 10 move vertically upwardly and downwardly on a lift frame 16 by hydraulic power, as is well known and understood. Since the lift frame 16 and its hydraulic elements are well known and understood, and since they are not directly a part of the present invention, they are not shown or discussed further.

The mast elements 6, 10 and 12 are secured to other elements, as well as to the lift frame 16, but for clarity and understanding of the present invention, such other elements are also not illustrated or discussed.

The shield apparatus 20 includes a flat plate center portion 22 which extends between the vertical mast elements or members 6 and 10 and above the horizontal forks 4 and 6. Extending upwardly from the center portion 22 are upper arms 24 and 28. At the upper ends of the upper arms 24 and 28 are rearwardly extending flanges 26 and 30. The flanges 26 and 30 extend over the cross member 12, while the arms 24 and 28 are disposed against the vertical mast members 6 and 10. The flanges 26 and 30 are generally perpendicular to the arms 24 and 28 and to the center portion 22.

A flange 40 extends from the arm 24 at about the juncture of the arm 24 to the center portion 22. The flange 40 is disposed generally against the side of the mast element or member 6. A handle 42 extends generally outwardly from the flange 40. The purpose of the handle 42 is for the installation and removal of the apparatus 20 to and from the fork lift truck 2. This will be explained below in conjunction with FIGS. 2, 2A, 2B, and 2C.

Another handle 46 extends outwardly from a flange generally parallel to the flange 40. The handle 46 is generally parallel to and aligned with the handle 42.

Extending below the center portion 22 are two lower arms 60 and 64. The arms 60 and 64 are also disposed against the vertical mast members 6 and 10, respectively. The arm 60 includes a flange 62 which is disposed generally perpendicularly to the arm 60. Similarly, the arm 64 includes a side flange (not shown) which is also disposed generally perpendicularly to the arm 64. The flange 62 and its parallel flange are disposed against the sides of the mast elements 6 and 10, respectively, while the arms 60 and 64 are disposed against the front of the arms 6 and 10, respectively. The apparatus 20 is in a general "H" configuration, with the portion 22 comprising the cross bar and the arm portions 24, 28 and 60, 64 comprising the vertical elements of the "H."

For securing the apparatus 20 to the forklift unit 2, six lock brackets are disposed in conjunction with the flanges 26, 30, 40, and a flange generally parallel to the flange 40 and to which the handle 46 is secured, and the lower flange 62 and its parallel flange extending from the arm 64. Each of the flanges includes a pair of elongated slots which receive threaded studs. The studs extend from lock brackets.

The flange 26 includes a pair of slots 80, the flange 30 includes a pair of slots 82, the flange 40 includes a pair of slots 84, the flange 62 includes a pair of slots 88, and the two flanges (not shown) on the arms 28 and 64 also includes slots.

The purpose of the slots is to allow for different sized elements on the different makes of fork lift trucks. The apparatus 20 may thus be easily mounted on fork lift trucks of different sizes.

The lock brackets include a pair of top lock brackets 100 and 110 and a pair of upper side lock brackets, including a bracket 120 and a bracket 130, and a lower side bracket 140 and a parallel side bracket 150. The side brackets 130 and 150 are, as indicated, disposed in conjunction with the side flanges not shown in FIG. 1.

The lock brackets 100, 110, 120, 130, 140, and 150 are disposed against the mast elements or members and beneath their respective flanges. Thus, the statements above regarding the disposition of the respective flanges "against" the mast members should be thus modified by the disposition or interposition of the lock brackets.

The lock brackets are substantially identical to each other. They comprise an angle bracket having two elements or legs disposed substantially perpendicular to each other. One element or leg is disposed beneath a flange and against the side of its mast member, and the other element or leg is disposed directly against the rear of its mast member.

FIG. 2 is a fragmentary side view in partial section through the lock bracket 100 and the flange 26. Since the lock brackets are substantially identical, FIG. 2 is representative of all of the lock brackets and their associated elements. The bracket 100 is disposed beneath the flange 26 and on the top of the cross member 12. The bracket 100 includes a leg 102 and a leg 104. A pair of threaded studs 106, one of which is shown in FIG. 2, extends upwardly from the leg 104 and into a pair of slots 80. A nut 108 is tightened against the flange 80 to help lock the bracket 100 and the flange 26, and accordingly the apparatus 20, to the member 12, and thus to the fork lift truck 2.

Each flange also includes another locking element, namely a threaded bolt which extends through an internally threaded aperture in the flange outboard of the two slots through which the threaded studs extend. In FIGS. 1 and 2, a lock bolt 160 is shown tightened against the arm 104 of the lock bracket 100. In FIG. 1, a lock bolt 164 is shown on the flange 40, and a lock bolt 168 is shown on the flange 62.

For securing the apparatus 20 in place, the lock brackets are secured to their respective flanges by the pairs of threaded studs extending from the lock brackets and through their aligned slots in the flanges. Nuts are then tightened on the studs against the flanges. A pair of nuts 108 is shown on the flange 26, and a pair of nuts 118 is shown on the flange 30. A pair of nuts 128 is shown on the flange 40, and a pair of nuts 148 is shown on the flange 62.

The installation of a shield 20 on a fork lift truck 2 is sequentially illustrated in FIGS. 3, 3A, 3B, and 3C. The four FIGS. 3, 3A, 3B, and 3C are front views of the forklift truck 2 and the shield apparatus 20. For the following discussion, reference will primarily be made to FIGS. 3, 3A, 3B, and 3C.

Figure 3:
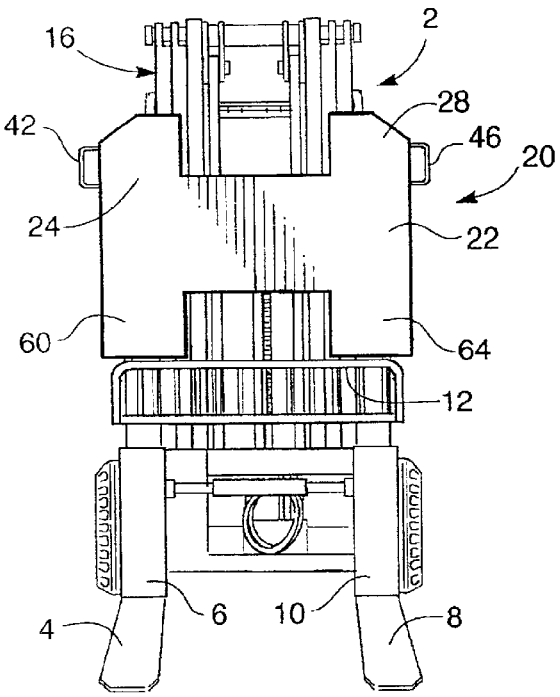
FIG. 3 is a front view illustrating the installation of the apparatus of the present invention on a fork lift truck.
Figure 3A:
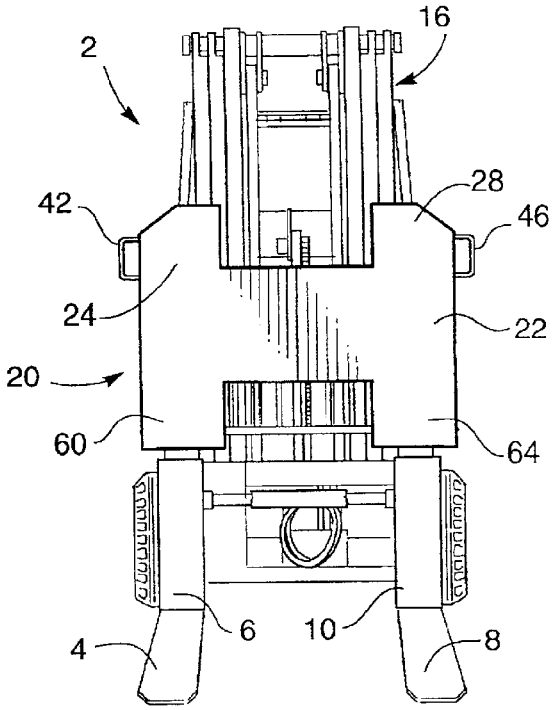
FIGS. 3A, 3B, and 3C are front views sequentially following FIG. 3 in the installation process.
Figure 3B:
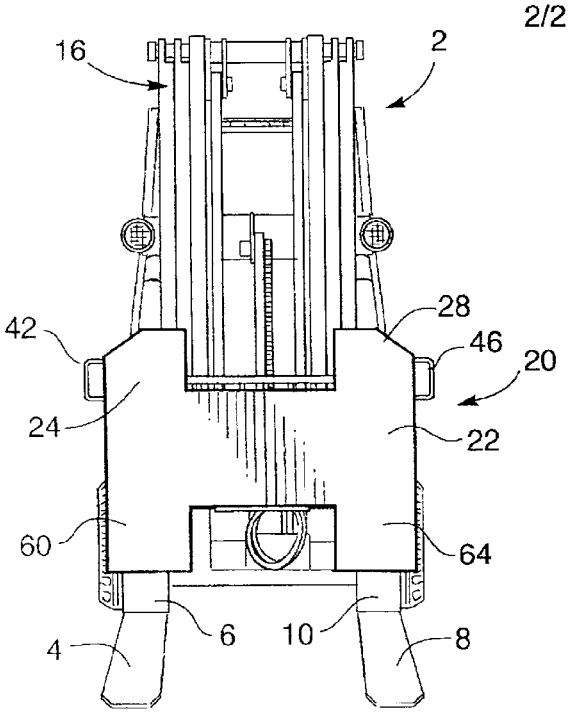
Figure 3C:
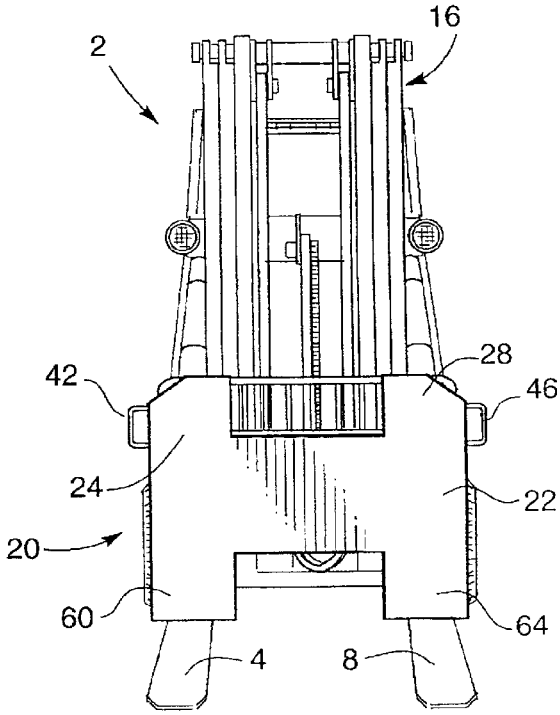

Two people grasp the apparatus 20 by the handles 42 and 46 and lift the shield 20 above the cross member 12. The shield 20 is then lowered on the member 12 and on the side mast members 6 and 10. The lowering is illustrated sequentially in FIGS. 3A and 3B. The shield is lowered on the mast elements until the lower side arms 60 and 64 are disposed on the forks 4 and 6, as shown in FIG. 3C.

With the shield apparatus 20 in place on the mast members and the forks, the lock brackets are adjusted against the respective members and the nut pairs and lock bolts are tightened to lock the apparatus 20 to the fork lift truck 2.

The shield apparatus 20 may be made of appropriate material, such as aluminum, plastic, etc. While weight may be a consideration, the ability of the material to withstand the impact of a load bearing against the shield is also an important consideration. The shield apparatus 20 is especially useful in protecting the edges of a load, such as wall board (or drywall), or other material which has relatively fragile edges, from being damaged while being moved by a fork lift truck. The central portion 22 of the shield apparatus 20 extends the full width of a fork lift truck carriage, including the forks and lift members, and thus protects the exposed edges of a load from impacting against the mast elements or members while the load is being transported or moved.

The arms 24, 28 and 60, 64 define, with the center portion 22, open viewing areas for the operator of the fork lift truck 2 to which the apparatus 20 is secured. The purpose of the open areas is to provide the operator or driver viewing areas through which the operator may view the material being loaded onto or picked up by the fork lift truck. Thus, an upper viewing area is defined above the center portion 22 and the arms 24 and 28, and a bottom or lower viewing area is defined between the lower arms 60 and 64 and below the center portion 22.

The arms 24, 28, and 60, 64 are sufficiently wide so as to provide the desired protection for exposed edges of whatever load is being transported by the fork lift truck 2. If desired, the lower arms 60 and 64 may extend almost the full width or distance between the mast elements, and thus essentially become part of an extended central portion 22, but reserving or still providing a viewing area for safety purposes. Thus, there may be a minimum width but not necessarily a maximum width, except for the safety viewing areas in the center.

The shield apparatus 20 is illustrated as having sloping shoulders on the outer corners of the respective upper arms, the shield apparatus may eliminate the sloping shoulders to provide generally rectangular arms, or the outer corners may be rounded, or otherwise, as desired. Similarly, the inner corners, i.e., the junctures of the arms and the center portion, may be rounded, sloping, etc., rather than the generally perpendicular inner corners as illustrated.

While the principles of the invention have been made clear in illustrative embodiments, without departing from those principles there may occur to those skilled in the art many modifications of structure, arrangement, proportions, the elements, materials, and components used in the practice of the invention, and otherwise, which are particularly adapted to specific environments and operative requirements. The appended claims are intended to cover and embrace any and all such modifications, within the limits only of the true spirit and scope of the invention.

What I claim is:

1. Shield apparatus for a fork lift truck having a pair of forks and a pair of vertical mast members and a cross member extending between the vertical members comprising in combination:

a generally flat plate center portion;

a first pair of arms extending upwardly from the center portion and disposed against the vertical mast members;

a second pair of arms extending downwardly from the center portion and disposed against the vertical mast members and on the pair of forks;

a first pair of flanges extending outwardly from the first pair of arms and disposed on the cross member;

a second pair of flanges extending outwardly at about the juncture of the first pair of arms and the center portion and disposed against the sides of the vertical mast members;

a third pair of flanges extending outwardly from the second pair of arms and disposed against the sides of the vertical mast members below the second pair of flanges;

a pair of handles secured to the second pair of flanges; and lock brackets disposed against the first, second, and third pairs of flanges to secure the flanges to the cross member and the vertical mast members.

2. The apparatus of claim 1 in which the lock brackets each include a first arm disposed against the flanges and the respective cross member and vertical mast members and a second arm disposed against the respective cross member and vertical mast members.

3. The apparatus of claim 2 in which the first and second arms are disposed substantially perpendicular to each other.

4. The apparatus of claim 3 in which the first arms include threaded studs.

5. The apparatus of claim 3 in which the flanges include slots for receiving the threaded studs.

6. The apparatus of claim 5 in which the slots are elongated for adjusting to different sizes of forklift truck cross members and vertical mast members.

7. The apparatus of claim 1 in which the lock brackets include lock elements which cooperate with the flanges.

8. The apparatus of claim 7 in which the flanges include slots for receiving lock elements on the lock brackets.

9. The apparatus of claim 1 in which the flanges include lock bolts to help secure the flanges to the arms of the lock brackets.

10. The apparatus of claim 9 in which the lock brackets include first arms and second arms, and the lock bolts are disposed against the first arms.

11. Shield apparatus for a fork lift truck having a pair of forks, a pair of mast members extending vertically and secured to the pair of forks, and a cross member secured to the pair of mast members comprising in combination:

a relatively flat first portion disposed against the pair of mast members;

first means for securing the first portion to the cross members;

a second portion extending upwardly from the first portion and disposed against one of the pair of mast members;

a third portion extending upwardly from the first portion and disposed against the other of the pair of mast members;

a fourth portion and a fifth portion disposed respectively in alignment with the second portion and the third portion and disposed on the pair of forks; and second means for securing the first portion to the pair of mast members including first fastening means secured to the fourth and fifth portions and further including first flanges extending generally perpendicular to the fourth and fifth portions, and first lock brackets securable to the pair of first flanges and to the pair of mast members.

12. The apparatus of claim 11 in which the first means for securing the first portion to the cross member includes second fastening means secured to the second and third portions.

13. The apparatus of claim 12 in which the second fastening means includes a pair of second flanges extending generally perpendicularly from the second and third portions.

14. The apparatus of claim 13 in which the second fastening means further includes second lock brackets securable to the cross member and to the second pair of flanges.

* * * * *